US006776105B2

(12) United States Patent
Rivera et al.

(10) Patent No.: US 6,776,105 B2
(45) Date of Patent: Aug. 17, 2004

(54) COLLAPSIBLE AND PORTABLE WORK STATION

(75) Inventors: Josue' Diaz Rivera, Franklin, MA (US); Peter Lavigne, Worcester, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/251,694

(22) Filed: Sep. 19, 2002

(65) Prior Publication Data

US 2003/0024043 A1 Feb. 6, 2003

Related U.S. Application Data

(62) Division of application No. 09/730,124, filed on Dec. 5, 2000, now abandoned.

(51) Int. Cl.[7] ..... A47B 3/00
(52) U.S. Cl. ..... 108/34; 108/24
(58) Field of Search ..... 108/34, 116, 123, 108/157.1, 157.15, 157.16, 24

(56) References Cited

U.S. PATENT DOCUMENTS 1,060,295 A * 4/1913 Stiles ..... 108/32
1,154,692 A * 9/1915 Dehullu ..... 108/34
2,862,777 A * 12/1958 Paige ..... 108/34
5,622,119 A * 4/1997 Hsieh ..... 108/115
5,778,800 A * 7/1998 Liang ..... 108/50.11
5,794,546 A * 8/1998 Carter ..... 108/115
5,865,127 A * 2/1999 Carter ..... 108/115
6,026,751 A * 2/2000 Tsai ..... 108/34
6,079,338 A * 6/2000 Yeh ..... 108/115
6,199,489 B1 * 3/2001 Tsai ..... 108/115
6,237,508 B1 * 5/2001 Weiss ..... 141/52

FOREIGN PATENT DOCUMENTS

JP 7-39425 * 10/1995

* cited by examiner

*Primary Examiner*—Jose V. Chen
(74) *Attorney, Agent, or Firm*—Vincent J. Ranucci

(57) ABSTRACT

A collapsible and portable work station, comprising a collapsible and portable leg structure and a top portion which may be flat or comprise a basin. The leg structure has a plurality of legs movably attached to each other, each leg having a top end, a bottom end and longitudinally extending axis. The legs are movable to a first configuration wherein the legs are in close proximity to one another such that the longitudinally extending axes of the legs are generally parallel to one another, and to a second configuration wherein the spacing between the legs is maximal. The top portion is removably attached to the top ends of the legs, the top portion comprising two sections movably attached to one another so as to allow the top portion to be folded such that the sections confront each other when the top portion is not attached to the leg structure.

9 Claims, 7 Drawing Sheets

COLLAPSIBLE AND PORTABLE WORK STATION

This is a division of U.S. Ser. No. 09/730,124, filed Dec. 5, 2000, now abandoned.

The invention described herein may be manufactured, used and licensed by or for the Government for Governmental purposes without the payment to us of any royalty thereon.

BACKGROUND OF THE INVENTION

1. Field of the Invention

The present invention generally relates to a collapsible work station that can be used for many purposes, such as a table, work bench or sink.

2. Problem to be Solved

There are many situations that require the use of work stations apart from the normal use of such devices. For example, it is often necessary to use temporary work stations at construction sites. Other situations also require the use of temporary work stations, such as camping and military field operations. What is needed is a new and improved work station that is relatively light in weight, portable and collapsible. Another important feature of such a work station is that it must be a multi-use work station that can be quickly converted into other forms, e.g. from a work table to a sink.

It is therefore an object of the present invention to provide a collapsible and portable work station that addresses the need discussed above.

Other objects and advantages of the present invention will be apparent to one of ordinary skill in the art in light of the ensuing description of the present invention.

SUMMARY OF THE INVENTION

In one aspect, the present invention is directed to a collapsible and portable work station, comprising a collapsible and portable leg structure comprising a plurality of legs movably attached to each other, each leg having a top end, a bottom end and longitudinally extending axis, the legs being movable to a first configuration wherein the legs are in close proximity to one another such that the longitudinally extending axes of the legs are generally parallel to one another, and to a second configuration wherein the legs are maximally spaced from one another, and a top portion removably attached to the top ends of the legs, the top portion comprising two sections movably attached to one another so as to allow the top portion to be folded such that the sections confront each other when the top portion is not attached to the leg structure. In one embodiment, each of the top portion sections comprises a substantially flat surface. In another embodiment, the top portion comprises a frame that defines a region for receiving a basin. The top portion further comprises means for removably securing the basin to the top portion.

BRIEF DESCRIPTION OF THE DRAWINGS

The features of the invention are believed to be novel and the elements characteristic of the invention are set forth with particularity in the appended claims. The invention itself, both as to organization and method of operation, may best be understood by reference to the detailed description which follows taken in conjunction with the accompanying drawings in which:

DETAILED DESCRIPTION OF THE INVENTION

Figure 1:
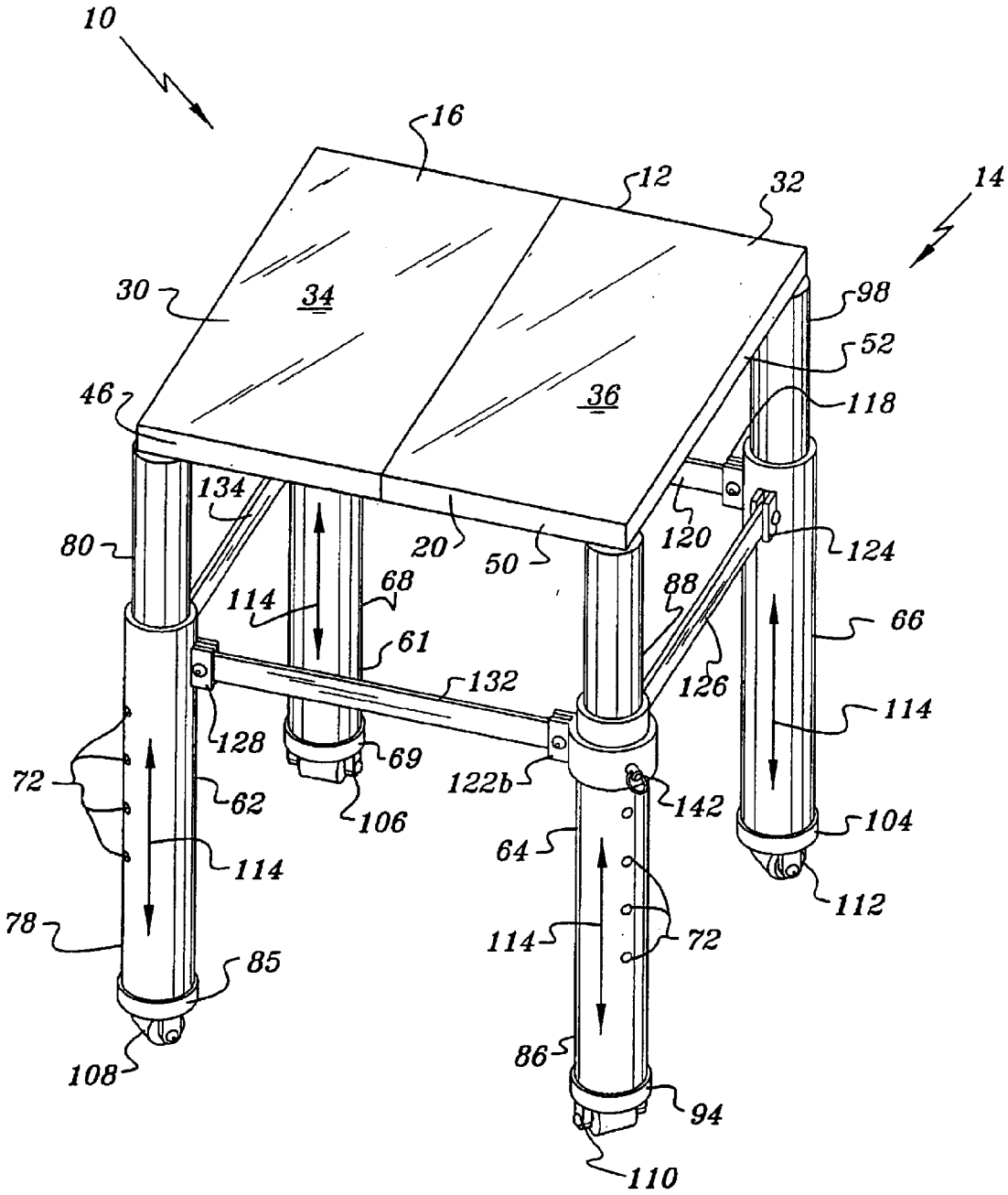
FIG. 1 is a perspective view of one embodiment of the collapsible and portable work station of the present invention.
Figure 2:
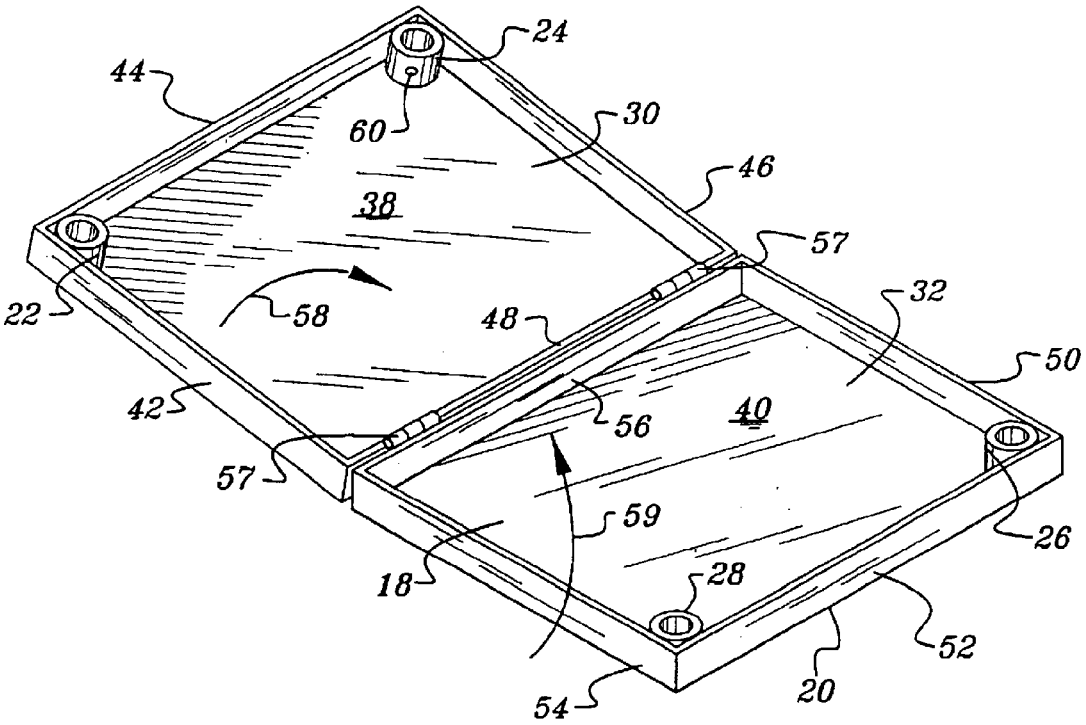
FIG. 2 is a perspective view of a top portion of the collapsible and portable work station of FIG. 1.

Referring to FIG. 1, there is shown a perspective view of one embodiment of the collapsible and portable work station of the present invention. Collapsible and portable work station 10 generally comprises a top portion 12 and collapsible leg structure 14. Referring to FIGS. 1 and 2, top portion 12 comprises top surface 16, bottom surface 18, side portion 20 that extends about the periphery of top portion 12, and leg attachment portions 22, 24, 26 and 28. In a preferred embodiment, top portion 12 is comprised of sections 30 and 32 which are movably attached to each other. Sections 30 and 32 have top surfaces 34 and 36, respectively, which taken together, define top surface 16. Sections 30 and 32 also have bottom surfaces 38 and 40, respectively, which taken together, define bottom surface 18. Section 30 comprises side portions 42, 44 and 46 which are part of side portion 20. Section 30 further comprises side portion 48. Leg attachment portion 22 is adjacent side portions 42 and 44 of section 30. Leg attachment portion 24 is adjacent to side portions 44 and 46 of section 30. Similarly, section 32 comprises side portions 50, 52 and 54 which are part of side portion 20. Section 32 further comprises side portion 56 which confronts side portion 48 of section 30. Leg attachment portion 26 is adjacent side portions 50 and 52. Leg attachment portion 28 is adjacent side portions 52 and 54.

Referring to FIG. 2, in one embodiment, sections 30 and 32 are attached to one another with hinges 57. In such a configuration, sections 30 and 32 pivot, with respect to each other, in the direction indicated arrows 58 and 59, respectively.

Referring to FIG. 1, in one embodiment, top surface 16 is generally planar. However, it is to be understood that top surface 16 can be assembled with different configurations depending upon the desired purpose of top surface 16. In one embodiment, top surface 16 is textured. In another embodiment, top surface 16 is generally smooth.

Referring to FIGS. 1 and 2, in a preferred embodiment, sections 30 and 32 are generally the same in size. However, it is to be understood that sections 30 and 32 can have different sizes. Sections 30 and 32 can also be configured so as to provide top portion 12 with any one of several geometrical shapes, rectangular, square, circular, etc.

Referring to FIG. 2, leg attachment portions 22, 24, 26 and 28 each have opening 60 for receiving a pin or screw (not shown) that is used to removably attach top portion 12 to the legs of leg structure 14. This aspect of the present invention is discussed in further detail in the ensuing description.

Referring to FIGS. 1, 3, 4 and 5, collapsible and portable leg structure 14 comprises legs 61, 62, 64 and 66 that are movably attached to each other. Leg section 61 comprises sections 68 and 70. In one embodiment, section 68 is generally tubular in configuration and section 70 is slidably disposed within the interior of section 68. Section 68 includes a plurality of equidistantly spaced openings 72. Section 70 includes a movable projection thereon (not shown) that is sized for moving within any of the openings 72 (not shown on section 68 but shown on the corresponding leg sections of legs 62, 64 and 66. The projection (not shown) is urged outward by a spring (not shown) so as to protrude through one of the openings 72. Thus, section 70 can be adjusted, with respect to section 68, by depressing the projection and sliding section 70 so as to enable the projection to enter the next successive opening 72. The foregoing configuration permits the overall length of the leg 61 to be adjusted depending upon the user's needs. The use of the projection and spring (not shown) is only one example of how section 70 can be adjusted according to the needs of a user. Other suitable configurations can also be used. Section 70 includes portion 74 that is sized for insertion into leg receiving portion 22. Portion 74 includes cavity 76 that is aligned with opening 60 when portion 74 is inserted into portion 22. A locking pin (not shown) is inserted into opening 60 and extends into cavity 76 so as to removably connect leg 61 to top portion 12. In another embodiment, opening 60 and cavity 76 are threaded so as to threadedly engage a screw (e.g. machine screw, Allen-type screw, etc.) Leg 61 further comprises bottom cap 69 that is attached to the bottom of leg section 68. In one embodiment, cap 69 is fabricated form rubber so as to provide sufficient friction between leg 61 and a surface in order to prevent sliding or slipping of leg 61 upon the surface.

Leg section 62 comprises sections 78 and 80. In one embodiment, section 78 is generally tubular in configuration and section 80 is slidably disposed within the interior of section 78. In one embodiment, section 78 is generally tubular in configuration and section 80 is slidably disposed within the interior of section 78. As described in the foregoing description, section 78 includes a plurality of equidistantly spaced openings 72. Section 80 includes a movable projection thereon (not shown) that is sized for moving within any of the openings 72. The projection (not shown) is urged outward by a spring (not shown) so as to protrude one of the openings 72. Thus, section 80 can be adjusted, with respect to section 78, by depressing the projection and sliding section 80 so as to enable the projection to enter the next successive opening 72. The foregoing configuration permits the overall length of the leg 61 to be adjusted depending upon the user's needs. The use of the projection and spring (not shown) is only one example of how the height of section 70 can be adjusted according to the needs of a user. Other suitable configurations can also be used. Section 70 includes portion 74 that is sized for insertion into leg receiving portion 22. Portion 74 includes cavity 76 that is aligned with opening 60 when portion 74 is inserted into portion 22. A locking pin (not shown) is inserted into opening 60 and extends into cavity 76 so as to removably connect leg 61 to top portion 12. In another embodiment, opening 60 and cavity 76 are threaded so as to threadedly engage a screw (e.g. machine screw, Allen-type screw, etc.) Section 70 includes a movable projection thereon (not shown) that is sized for moving within any of the openings 72 (not shown on section 68 but shown on the corresponding leg sections of legs 62, 64 and 66. The projection (not shown) is urged outward by a spring (not shown). Thus, section 80 can be adjusted, with respect to section 78, by depressing the projection and sliding section 80 so as to enable the projection to enter the next successive opening 72. The foregoing configuration permits the overall length of the leg 62 to be adjusted depending upon the user's needs. The use of the projection and spring (not shown) is only one example of how section 80 can be adjusted according to the needs of a user. Other suitable configurations can also be used. Section 80 includes portion 82 that is sized for insertion into leg receiving portion 24. Portion 82 includes a cavity 84 that is aligned with opening 60 when portion 82 is inserted into portion 24. A locking pin (not shown) is inserted into opening 60 and extends into cavity 84 so as to removably connect leg 62 to top portion 12. In another embodiment, opening 60 and cavity 84 are threaded so as to threadedly engage a screw (e.g. machine screw, Allen-type screw, etc.). Leg 62 further comprises bottom cap 85 that is attached to the bottom of leg section 78. In one embodiment, cap 85 is fabricated form rubber so as to provide sufficient friction between leg 62 and a surface in order to prevent sliding or slipping of leg 62 upon the surface.

Similarly, leg section 64 comprises sections 86 and 88. In one embodiment, section 86 is generally tubular in configuration and section 88 is slidably disposed within the interior of section 86. Section 86 includes a plurality of equidistantly spaced openings 72. Section 88 includes a movable projection thereon (not shown) that is sized for moving within any of the openings 72. The projection (not shown) is urged outward by a spring (not shown). Thus, section 88 can be adjusted, with respect to section 86, by depressing the projection and sliding section 88 so as to enable the projection to enter the next successive opening 72. The foregoing configuration permits the overall length of the leg 64 to be adjusted depending upon the user's needs. The use of the projection and spring (not shown) is only one example of how section 88 can be adjusted according to the needs of a user. Other suitable configurations can also be used. Section 88 includes portion 90 that is sized for insertion into leg receiving portion 26. Portion 90 includes cavity 92 that is aligned with opening 60 when portion 90 is inserted into portion 26. A locking pin (not shown) is inserted into opening 60 and extends into cavity 92 so as to removably connect leg 61 to top portion 12. In another embodiment, opening 60 and cavity 92 are threaded so as to threadedly engage a screw (e.g. machine screw, Allen-type screw, etc.). Leg 64 further comprises bottom cap 94 that is attached to the bottom of leg section 88. In one embodiment, cap 94 is fabricated from rubber so as to provide sufficient friction between leg 64 and the surface upon which leg 64 is mounted in order to prevent sliding or slipping of leg 64 upon the surface.

Similarly, leg section 66 comprises sections 96 and 98. In one embodiment, section 96 is generally tubular in configuration and section 98 is slidably disposed within the interior of section 96. Section 96 includes a plurality of equidistantly spaced openings 72. Section 98 includes a movable projection thereon (not shown) that is sized for moving within any of the openings 72. The projection (not shown) is urged outward by a spring (not shown). Thus, section 98 can be adjusted, with respect to section 96, by depressing the projection and sliding section 98 so as to enable the projection to enter the next successive opening 72. The foregoing configuration permits the overall length of the leg 66 to be adjusted depending upon the user's needs. The use of the projection and spring (not shown) is only one example of how section 98 can be adjusted according to the needs of a user. Other suitable configurations can also be used. Section 98 includes portion 100 that is sized for insertion into leg receiving portion 28. Portion 100 includes cavity 102 that is aligned with opening 60 when portion 100 is inserted into portion 28. A locking pin (not shown) is inserted into opening 60 and extends into cavity 102 so as to removably connect leg 66 to top portion 12. In another embodiment, opening 60 and cavity 102 are threaded so as to threadedly engage a screw (e.g. machine screw, Allen-type screw, etc.). Leg 66 further comprises bottom cap 104 that is attached to the bottom of leg section 98. In one embodiment, cap 104 is fabricated from rubber so as to provide sufficient friction between leg 66 and the surface upon which leg 66 is mounted in order to prevent sliding or slipping of leg 66 upon the surface.

In one embodiment, leg structure 14 comprises wheel assemblies 106, 108, 110 and 112 that attached to bottom caps 69, 85, 94 and 104, respectively, and enable leg structure 14 to be rolled across the surface upon which leg structure 14 is positioned.

Figure 3:
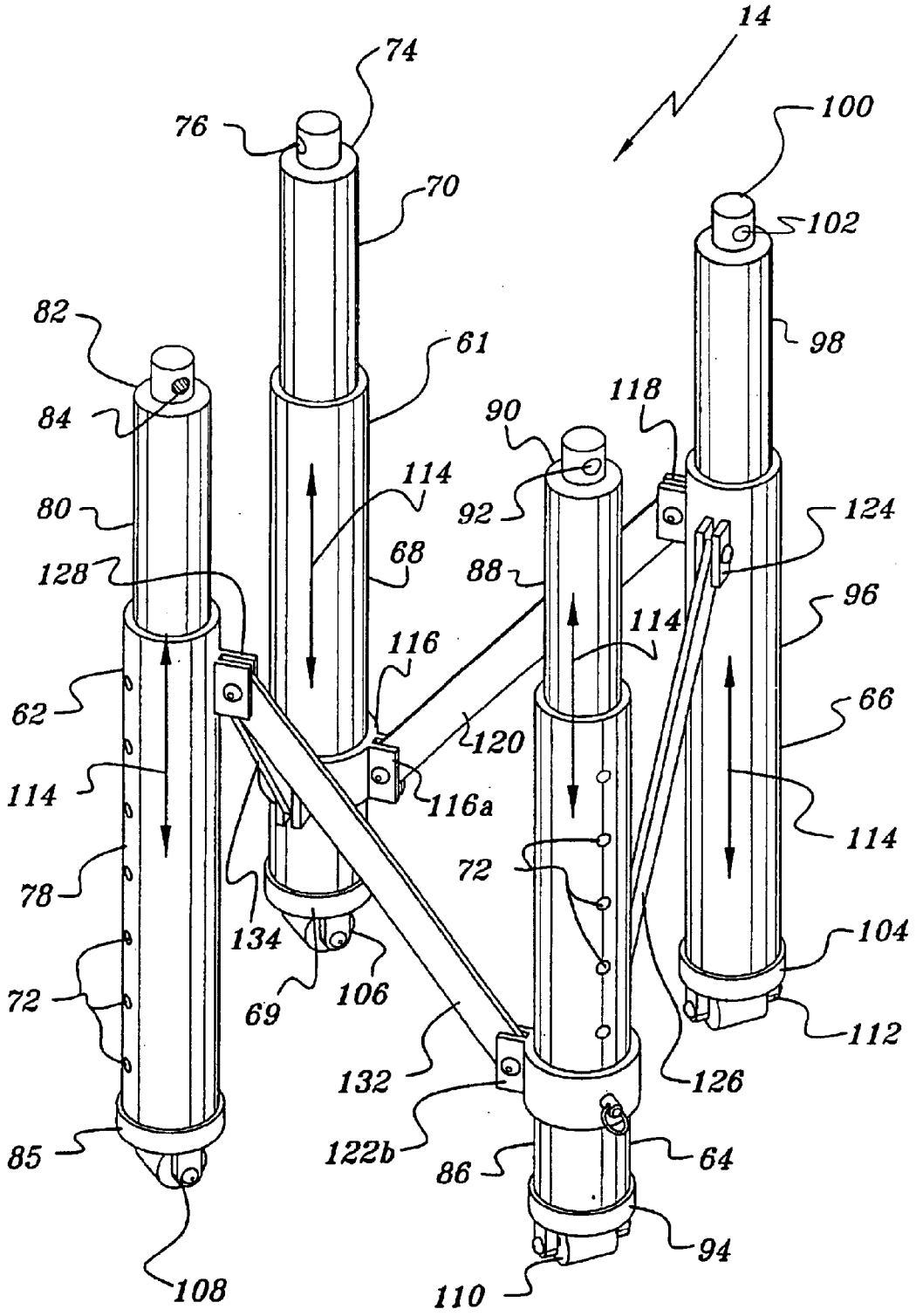
FIG. 3 is a perspective view of a collapsible and portable leg structure of the collapsible and portable work station of FIG. 1.
Figure 4:
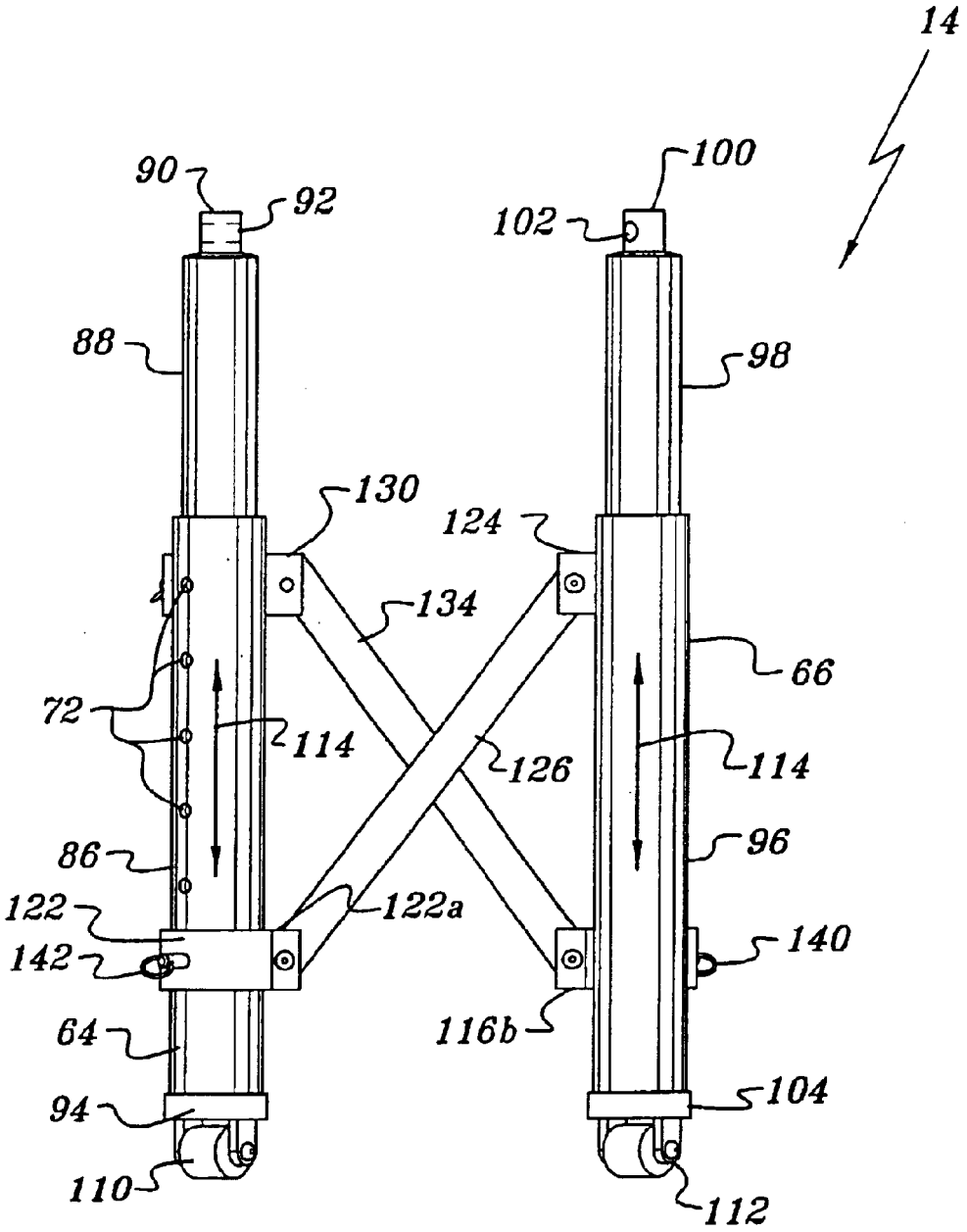
FIG. 4 is a side elevational view of a pair of legs of the collapsible and portable leg structure of FIG. 3.
Figure 5:
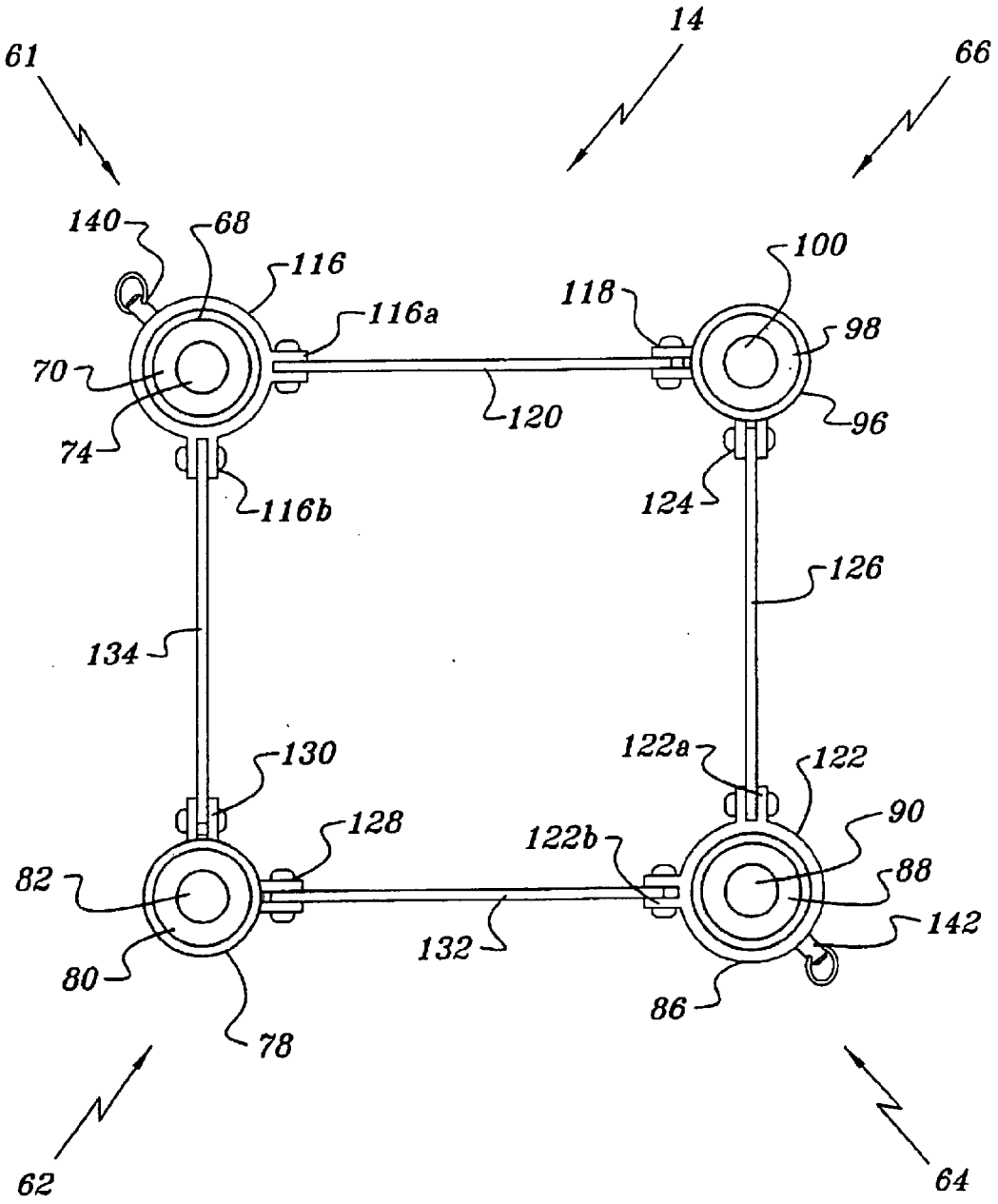
FIG. 5 is a bottom view of the collapsible and portable leg structure when the legs of this structure are in a collapsed position.

Each leg 61, 62, 64 and 66 has a longitudinally extending axis 114. As the ensuing description will show, legs 61, 62, 64 and 66 are movably attached to one another. Specifically, leg 61 has ring 116 slidably mounted upon leg section 68. Ring 116 further includes portions 116*a* and 116*b* attached thereto. Leg section 96 of leg 66 has extending portion 118 attached thereto. Leg structure 14 further includes member 120 that is pivotally attached to ring portion 116*a* and portion 118. Similarly, leg 64 has ring 122 slidably mounted upon leg section 86. Ring 122 includes portions 122*a* and 122*b* attached thereto. Leg section 96 of leg 66 has extending portion 124 attached thereto. Leg structure 14 further includes member 126 that is pivotally attached to ring portion 122*a* and portion 124. Section 78 of leg 62 has extending portions 128 and 130 attached thereto. Leg structure 14 further includes member 132 that is pivotally attached to ring 128 and ring portion 122*b*. Similarly, leg structure 14 further includes member 134 that is pivotally attached to ring portion 116*b* and portion 130. As a result of the pivotal attachment of members 120, 126, 132 and 134, and slidable rings 116 and 122, legs 61, 62, 64 and 66 are movable to a first configuration wherein legs 61, 62, 64 and 66 are in close proximity to one another such that longitudinally extending axes 114 are generally parallel to one another, as shown in FIG. 5, and to a second configuration wherein legs 61, 62, 64 and 66 are maximally spaced from one another, as shown in FIGS. 1, and 3. In one embodiment, rings 116 and 122 include locking pins 140 and 142, respectively, for preventing movement of rings 116 and 122 upon leg sections 68 and 86, respectively.

Figure 6:
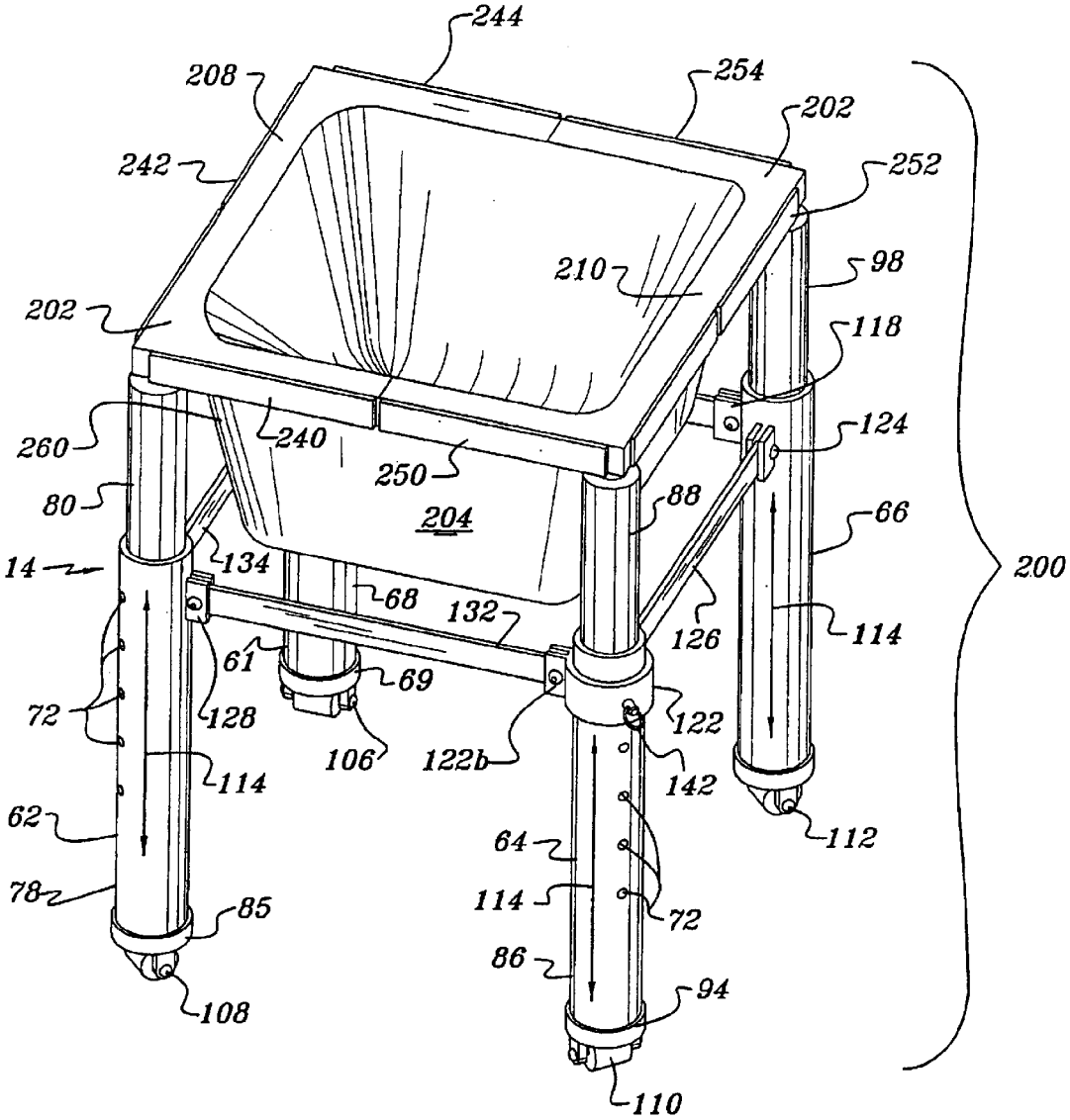
FIG. 6 is a perspective view of the collapsible and portable work station of the present invention configured as a sink.
Figure 7:
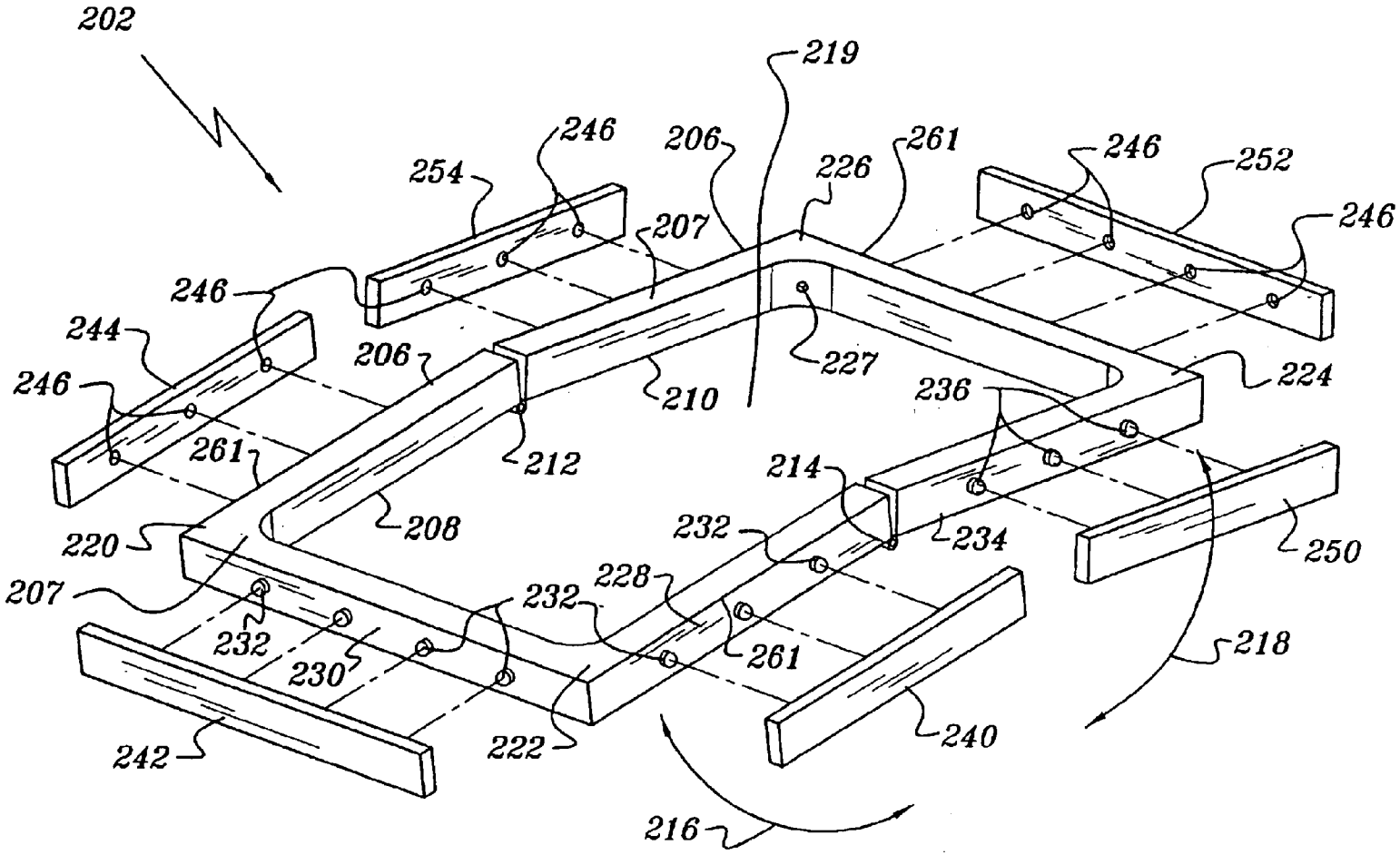
FIG. 7 is a perspective view of a top portion of the collapsible and portable work station of FIG. 6.

Referring to FIGS. 6 and 7, there is shown the collapsible and portable work station of the present invention configured as a sink. Collapsible and portable work station 200 comprises leg structure 14, which has been described in the foregoing description, top portion 202 and sink or basin 204. Top portion 202 generally comprises main frame portion 206. Main frame portion 206 comprises sections 208 and 210 that are movably attached together. In one embodiment, hinges 212 and 214 are used to attach sections 208 and 210 together. Hinges 212 and 214 enable sections 208 and 210 to pivot in the directions indicated by arrows 216 and 218. When sections 208 and 210 are opened, as shown in FIGS. 6 and 7, main frame portion 206 defines region 219 for receiving sink or basin 204.

Referring to FIGS. 6 and 7, section 208 has receptacles underneath (not shown) and at each corner 220 and 222 for receiving leg portions 82 and 90, respectively. In one embodiment, section 208 is hollow. In another embodiment, section 208 is solid. The aforementioned receptacle is similar in configuration to receptacle 22 described in the foregoing description. Similarly, section 210 has a receptacle underneath (not shown) at each corner 224 and 226 for receiving leg portions 100 and 74, respectively. In one embodiment, section 210 is hollow. In another embodiment, section 210 is solid. Each corner portion 220, 222, 224 and 226 has opening 227 that is aligned with the opening in the corresponding leg portion (i.e. leg portion 82, 90, 74 and 100) for receiving a locking pin in order to removably attach legs 61, 62, 64 and 66 to main frame portion 206.

Referring to FIGS. 6 and 7, section 208 has side portions 228, 230 and a third side portion opposite side portion 228 but not shown. Projections 232 extend outward from side portion 228 and 230 and the third side portion not shown. Similarly, section 210 has side portion 234, another side portion not shown but opposite side portion 230, and a third side portion not shown but which is opposite side portion 234. Projections 236 extend outward from side portion 234 and the other side portions of section 210.

Referring to FIGS. 6 and 7, top portion 202 further includes movable side members 240, 242, 244 that are movably attached to side portions 228, 230 and the third, but not shown, side portion of section 208, respectively. In a preferred embodiment, 240, 242, 244 are hingedly attached to these aforementioned side portions of section 208. Each side members 240, 242, 244 has cavities 246 on the inner sides facing the side portions of section 208. Each cavity 246 is sized for receiving a corresponding projection 232. Thus, when side members 240, 242, 244 are moved such that the inner side of each side member 240, 242 and 244 confront the corresponding side member of section 208, projections 232 are substantially disposed within corresponding cavities 246. The purpose of such a configuration is discussed in the ensuing description.

Referring to FIGS. 6 and 7, top portion 202 further includes movable side members 250, 252, 254 that are movably attached to side portions 234 and the other side portions (not shown) of section 210, respectively. In a preferred embodiment, 250, 252, 254 are hingedly attached to these aforementioned side portions of section 210. Each side member 250, 252, 254 has cavities 246 on the inner sides facing the side portions of section 210. Each cavity 246 is sized for receiving a projection 236. Thus, when side members 250, 252, 254 are moved such that the inner side of each side member 250, 252 and 254 confront the corresponding side member of section 210, projections 236 are substantially disposed within a corresponding cavity 246 as shown in FIG. 7. The purpose of such a configuration is discussed in the ensuing description.

Referring to FIG. 6, sink or basin 204 is disposed with region 219 defined by main frame portion 206. Sink or basin 204 has a body portion 260 and peripheral portion (not shown) that comprises a plurality of sections. Each section of the peripheral portion has a plurality of rings or grommets with openings therethrough (not shown) wherein each ring is sized for receiving a corresponding projection such as projections 232 or projections 234 (see FIG. 7). Referring to FIGS. 6 and 7, in order to position basin 204 within region 204, side members 240, 242, 244, 250, 252 and 254 are pivoted upward so that each side member is generally parallel with top surface 207 of top portion 206 and a space is created between the side members (i.e. 240, 242, etc.) and edge 261 of top portion 206. Body portion 260 is then disposed within region 219 and each section of the peripheral portion of basin 204 is then inserted between a corresponding space between each of the side members (i.e. 240, 242, etc.) and edge 261. Once each peripheral edge section of sink or basin 204 is inserted through the aforementioned corresponding spaces, each peripheral edge section is draped over the sides of sections 208 and 210 and positioned so that the opening of each ring or grommet of the peripheral edge section receives a corresponding projection 232 or 236. Once this accomplished, all the side members (i.e. 240, 242, etc.) are lowered as shown in FIG. 6 so projections 232 and 236 protrude into corresponding cavities 246. Such a configuration prevents dislodgment of sink or basin 204 when disposed in region 219. The weight of the liquid contained in sink or basin 204 provides a tensile force that maintains lodgment of projections 232 and 236 within the openings of the peripheral portion of sink or basin 204 and cavities 246. Once the liquid is drained from basin 204, the steps mentioned above are reversed in order to remove basin 204 from top portion 202.

Referring to FIG. 6, in one embodiment, sink or basin 204 is fabricated from a coated, heat, puncture and tear resistant fabric. In another embodiment, sink or basin 204 is fabricated from naturally folded plastic. The material from which sink or basin 204 is fabricated cooperates with collapsible and portable leg structure 14 to provide a collapsible and portable sink that can be easily disassembled, transported and stored. Basin 204 further includes a drain (not shown) that is fabricated from plastic, aluminum or stainless steel.

In an alternate embodiment, a water pump (not shown) is attached to either top portion 202 or leg structure 14 in order to provide water to basin 204. Similarly, faucets (not shown) or sprayers (not shown) can also be attached to top portion 202 and connected to the aforementioned water pump or other water supply.

Referring to FIGS. 2, 3, 6 and 7, top portion 12, leg structure 14 and top portion 202 can be fabricated from a variety of materials, aluminum, stainless steel, plastic, or other lightweight and high strength materials. In a preferred embodiment, extruded aluminum wherever possible so as to reduce the amount of material, weight and manufacturing costs.

Thus, the collapsible and portable work stations 10 and 200 of the present invention:

a) are relatively light in weight and portable thereby requiring only one person to carry work stations 10 or 200;

b) easy to assemble and disassemble;

c) do not require tools for assembly or disassembly;

d) are collapsible for easy storage;

e) convertible to provide different functions, e.g. work table, disch sink, hand wash sink, etc.;

f) can be fabricated from a variety of low-cost, light weight and high strength materials;

g) can be used in many applications, e.g. camping, military field operations, emergency field hospitals in areas affected by natural disasters such as hurricanes, tornadoes, earthquakes, volcanic eruptions, etc. and h) can be manufactured at a relatively low per-unit cost.

The principals, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

Thus, having described the invention, what is claimed is:

1. A collapsible and portable work station, comprising:

a collapsible and portable leg structure comprising a plurality of legs movably attached to each other, each leg having a top end, a bottom end and longitudinally extending axis, the legs being movable to a first configuration wherein the legs are in close proximity to one another such that the longitudinally extending axes of the legs are generally parallel to one another, and to a second configuration wherein the legs are maximally spaced from one another; and a top portion removably attached to the top ends of the legs, the top portion comprising two sections movably attached to one another so as to allow the top portion to be folded such that the sections confront each other when the top portion is not attached to the leg structure;

wherein the top portion further comprising a frame that defines an opening, the frame having a pair of sections movably attached to one another, each section of the frame defining a corresponding section of the top portion, and the top portion further comprising a basin for containing a liquid, the basin having a body portion for collecting a fluid which body portion is disposed within the opening of the frame, and a peripheral portion removably secured to the frame, and wherein the peripheral portion of the basin includes a plurality of rings, each ring having an opening there through, the frame further comprising a side portion and a plurality of projections extending outward from the side portion, each projection being disposed through a corresponding opening through a ring of the peripheral portion of the basin.

2. The collapsible and portable work station according to claim 1 further comprising a movable side member pivotally attached to the side portion of the frame, the movable side member having a cavity sized for receiving a corresponding one of the projections extending from the side portion, the movable side member being pivotal between a first position in which the peripheral portion of the basin is intermediate the movable side member and the side portion of the frame, and the projections extending from the side portion and through corresponding openings through the rings of the peripheral portion of the basin are disposed within the cavities of the movable side member, and a second position in which the movable side member is positioned away from the side portion of the frame such that the projections are no longer disposed within the cavities of the movable side member.

3. The collapsible and portable work station according to claim 1 further comprising a plurality of wheels, each wheel being attached to the bottom end of each leg to facilitate movement of the work station.

4. The collapsible and portable work station according to claim 1 wherein the plurality of legs comprises four legs.

5. The collapsible and portable work station according to claim 4 further comprising:

a first annular member slidably mounted on a first one of the legs;

a second annular member slidably mounted on a second one of the legs that is diagonally positioned with respect to the first one of the legs;

a first connecting member pivotally attached to the first annular member and a third one of the legs;

a second connecting member pivotally attached to the third one of the legs and the second annular member;

a third connecting member pivotally attached to the second annular member and a fourth one of the legs; and a fourth connecting member pivotally attached to the third one of the legs and the first annular member.

6. The collapsible and portable work station according to claim 1 wherein each leg is comprised of a plurality of telescoping leg sections.

7. The collapsible and portable work station according to claim 1 wherein the top portion is generally rectangular in shape.

8. The collapsible and portable work station according to claim 1 wherein the top portion is generally square in shape.

9. The collapsible and portable work station according to claim 1 wherein the sections are generally the same in size.

* * * * *

UNITED STATES PATENT AND TRADEMARK OFFICE

CERTIFICATE OF CORRECTION

PATENT NO. : 6,776,105 B2 
DATED : August 17, 2004
INVENTOR(S) : Josue' Diaz Rivera and Peter Lavigne It is certified that error appears in the above-identified patent and that said Letters Patent is hereby corrected as shown below:

Title page,
Item [12], "Rivera et al." should read -- Diaz-Rivera et al. --

Signed and Sealed this

Twenty-first Day of December, 2004

JON W. DUDAS
*Director of the United States Patent and Trademark Office*

UNITED STATES PATENT AND TRADEMARK OFFICE

CERTIFICATE OF CORRECTION

PATENT NO. : 6,776,105 B2 
DATED : August 17, 2004
INVENTOR(S) : Josué Diaz Rivera and Peter Lavigne It is certified that error appears in the above-identified patent and that said Letters Patent is hereby corrected as shown below:

Title page,
Item [12], should read -- Diaz-Rivera et al. --
Item [73], Assignee, should read -- The United States of America as represented by the Secretary of the Army, Washington, DC (US) --

Signed and Sealed this

Fourth Day of January, 2005

JON W. DUDAS
*Director of the United States Patent and Trademark Office*